US009777594B2

(12) United States Patent
Lang

(10) Patent No.: US 9,777,594 B2
(45) Date of Patent: Oct. 3, 2017

(54) ENERGY DAMPING SYSTEM FOR GAS TURBINE ENGINE STATIONARY VANE

(71) Applicant: Siemens Energy, Inc., Orlando, FL (US)

(72) Inventor: Matthew H. Lang, Orlando, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 309 days.

(21) Appl. No.: 14/687,052

(22) Filed: Apr. 15, 2015

(65) Prior Publication Data

US 2016/0305278 A1 Oct. 20, 2016

(51) Int. Cl.

| | |
|---|---|
| ***F01D 25/04*** | (2006.01) |
| ***F01D 9/04*** | (2006.01) |
| ***F01D 5/22*** | (2006.01) |
| ***F01D 25/24*** | (2006.01) |

(52) U.S. Cl.

CPC ..... *F01D 25/04* (2013.01); *F01D 5/22* (2013.01); *F01D 9/041* (2013.01); *F01D 25/246* (2013.01); *F05D 2240/10* (2013.01); *F05D 2260/96* (2013.01)

(58) Field of Classification Search

CPC ..... F01D 5/22; F01D 5/24; F01D 5/26; F01D 25/04; F01D 25/06

See application file for complete search history.

(56) References Cited

U.S. PATENT DOCUMENTS

| | | | | |
|---|---|---|---|---|
| 2,916,257 | A | 12/1953 | Poellmitz et al. | |
| 5,490,759 | A * | 2/1996 | Hoffman | F01D 5/26 415/10 |
| 5,591,003 | A | 1/1997 | Boyd et al. | |
| 6,050,776 | A | 4/2000 | Akagi et al. | |
| 6,102,664 | A | 8/2000 | Nguyen | |
| 6,343,912 | B1 | 2/2002 | Manteiga et al. | |

(Continued)

FOREIGN PATENT DOCUMENTS

| | | | | |
|---|---|---|---|---|
| DE | 102010041808 | A1 * | 4/2012 | F01D 5/225 |
| EP | 0335299 | A1 * | 10/1989 | F01D 5/225 |

(Continued)

OTHER PUBLICATIONS

English translation of FR 1552101.*
English translation of EP 0335299.*
English translation of DE 102010041808.*

*Primary Examiner* — Woody Lee, Jr.
*Assistant Examiner* — Topaz L Elliott

(57) ABSTRACT

A stage (10) of stationary vanes (12) of a gas turbine engine, including: a plurality of stationary vanes disposed in an annular array (14); and an energy damping system (30) having a plurality of connection assemblies (32), each joining respective adjacent stationary vanes. A spring (34) is configured to circumferentially bias respective adjacent stationary vanes, and a damper (36) is configured to oppose relative circumferential movement between the respective adjacent stationary vanes. The connection of the overall assembly disclosed herein allows for the oscillating system to decrease its amplitude over the shortest time period no matter the conditions. This reduces wear compared to underdamped arrangements that do not decrease amplitude as quickly.

19 Claims, 5 Drawing Sheets

(56) References Cited

U.S. PATENT DOCUMENTS

| | | | | |
|---|---|---|---|---|
| 6,984,108 | B2 * | 1/2006 | Anderson | F01D 5/22 415/208.1 |
| 7,104,752 | B2 * | 9/2006 | Matheny | F01D 5/225 415/119 |
| 7,651,319 | B2 | 1/2010 | Anerson et al. | |
| 7,874,791 | B2 * | 1/2011 | Ferber | F01D 5/225 415/137 |
| 7,887,286 | B2 * | 2/2011 | Abgrall | F01D 5/225 277/647 |
| 8,206,094 | B2 | 6/2012 | Seki et al. | |
| 8,206,100 | B2 * | 6/2012 | Schuler | F01D 25/06 415/119 |
| 8,616,849 | B2 | 12/2013 | Menheere et al. | |
| 9,347,327 | B2 * | 5/2016 | Armstrong | F01D 9/00 |
| 2002/0085913 | A1 | 7/2002 | Bos | |
| 2008/0273983 | A1 * | 11/2008 | Clark | F01D 5/147 416/223 A |
| 2013/0336794 | A1 * | 12/2013 | Armstrong | F01D 9/00 416/189 |

FOREIGN PATENT DOCUMENTS

| | | | | |
|---|---|---|---|---|
| FR | 1552101 A | * | 1/1969 | F01D 5/22 |
| GB | 623525 A | * | 5/1949 | F01D 5/22 |

* cited by examiner

ENERGY DAMPING SYSTEM FOR GAS TURBINE ENGINE STATIONARY VANE

FIELD OF THE INVENTION

The invention relates to an energy damping system for stationary vanes and airfoils in a gas turbine engine

BACKGROUND OF THE INVENTION

A stage of stationary vanes in a turbine of a gas turbine engine includes an annular array of stationary vanes. During operation in the turbine, the vanes redirect a flow of combustion gases for delivery at the proper angle to a downstream row of rotating blades. A stage of stationary airfoils in a compressor includes an annular array of stationary airfoils. During operation in the compressor, the airfoils redirect a flow of compressed air. For sake of simplicity, turbine stationary vanes and compressor stationary airfoils are referred to herein as stationary vanes, or simply vanes. A singlet vane includes an inner shroud, an outer shroud, and one airfoil connecting the two, while a vane is generally considered to include an inner shroud, an outer shroud, and one airfoil connecting to an adjacent or multiple adjacent airfoils. Singlets and stationary vanes are referred to herein as vanes. Singlets/vanes may be manufactured by any means. Two or more singlets or vanes may be joined to form a stationary vane sub-assembly.

The stationary vanes are located upstream and downstream of rotating components. The stationary vanes deal with a multitude of stimulation from their rotating neighbors and variations from suction and pressure surfaces of the airfoil as the flow passes over them. The outer shroud of a stationary vane assembly has a hook feature that slides into a casing groove feature. The outer shroud secures the stationary vanes to the frame casing of the gas turbine. The frame casing is a relatively more rigid body than the vane assembly. The casing can carry singular or multiple stationary vane assemblies. In addition, the outer shroud secures the stationary vanes to the frame of the gas turbine engine, and is relatively more rigid than the airfoil of the vane. At the interface between the airfoil and the outer shroud, where the airfoil meets the relatively more rigid outer shroud, known issues of friction, vibration and wear are common.

The main locations of the wear is between the vane's hook to casing grooves and the mating faces of adjacent vanes. As a result, stationary vanes consistently show wear at their mechanical interfaces even though the parts are viewed as stationary components. Consequently, there remains room in the art for improvement

BRIEF DESCRIPTION OF THE DRAWINGS

The invention is explained in the following description in view of the drawings that show.

DETAILED DESCRIPTION OF THE INVENTION

Figure 1:
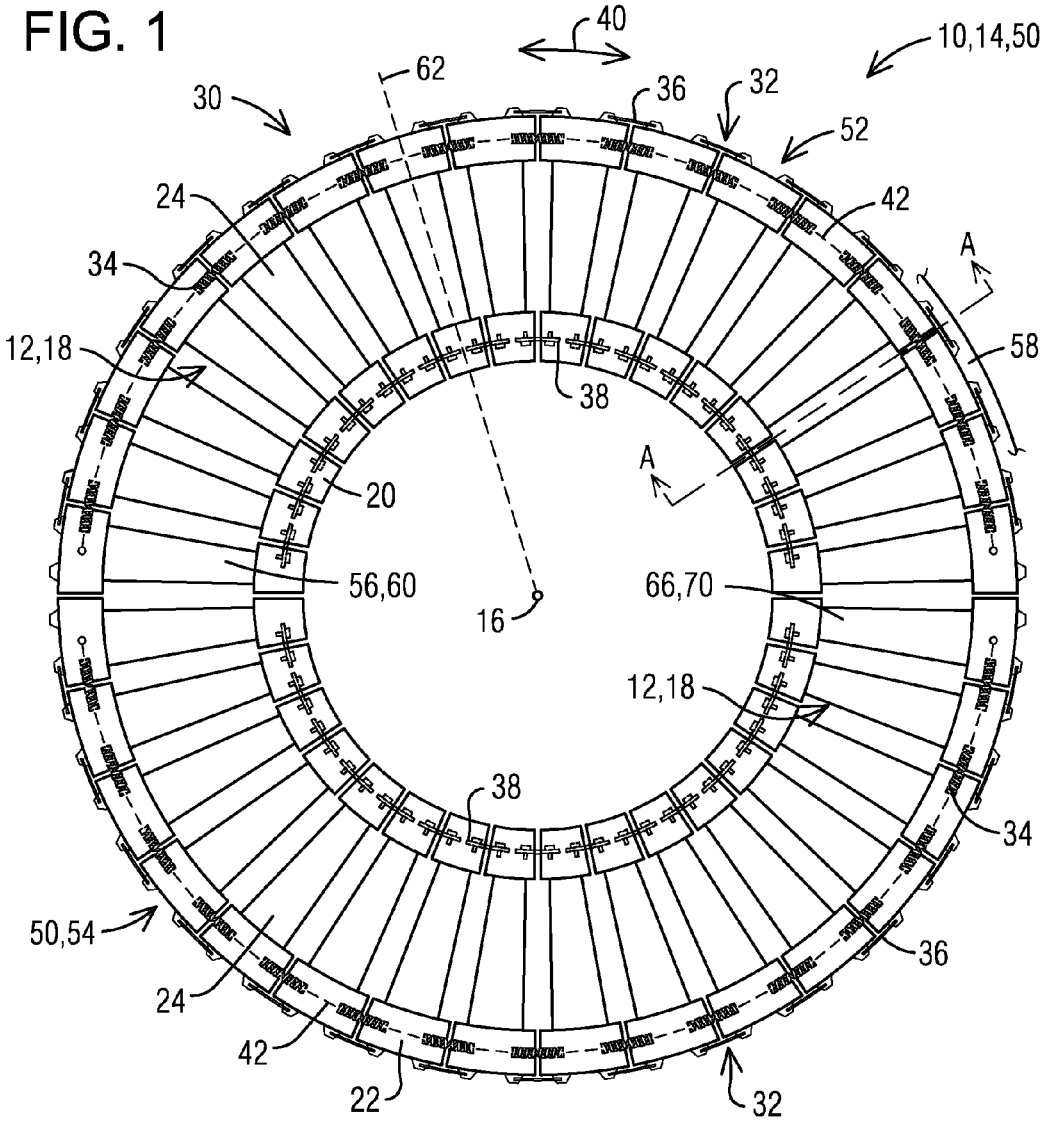
FIG. 1 is a front view of an exemplary embodiment of a compressor vane stage of a gas turbine engine

The present inventor has recognized that wear, friction and cracks may be forming at the interfaces between the outer shrouds of the vane and the casing groove that retains the vane assembly used in a gas turbine engine. The inventor has further recognized that this is because the airfoil of the vane is relatively less rigid and relatively free to vibrate, while the outer shroud of the vane is relatively rigid and relatively less free to vibrate due to being secured to a frame of the gas turbine engine. In addition, the present inventor has recognized that wear may be forming at the interfaces between the shrouds of the vanes and adjacent vane segment mating faces for similar reasons. The energy in the vibrating vane is thus directed into the mechanical interfaces of adjacent vanes, assembly anti-rotation features, and the casing frame groove interface. The vane mating faces that interface with adjacent vanes and the outer shroud hook to the casing frame groove have various mechanical interface geometries which lead to wear, friction and cracks. In some stationary vane configurations the airfoil is welded to the outer shroud at an interface, further aggravating the potential for crack formation and propagation at the weld. Further, the inventor recognizes that this problem may be exacerbated over time as gas turbine engine demand for power requires an airfoil and count change to achieve higher pressure ratios and increased mass flow. The arrangement disclosed herein is a system that addresses dampened and simple harmonic motion of singular bodies and assemblies.

Conventional practice to reduce wear, friction, and cracks has been to increase the amount of material in the shrouds and to design thicker airfoils to decrease freedom between the outer shroud and its interface with the gas turbine engine. For example, in configurations where the outer shroud resides in an annular groove, the outer shroud is made more structurally substantial, and the over-designed outer shroud is held in place tightly in the groove. The airfoils may also be thickened to handle the stresses. The airfoils, if retaining thicker overall profiles, will reduce vibratory motion, however, this will affect performance. Of note, all airfoils are designed to handle the steady and peak stresses with a safety factor. In addition, airfoils are tuned to stay away from certain driver wakes from upstream and downstream blades. However, disclosed herein is an arrangement that enables the shrouds with a certain Young's Modulus and mass to dampen out the vibrational energy coming from the airfoils. In essence, the flow energy across each airfoil causes a reaction to move outwards and onwards to the shroud hooks. The airfoil is stuck between two fixed points causing those connections points to dissipate that excess energy that the airfoil cannot. At the hooks the mechanical interfaces oscillate at certain frequencies causing friction and heat thereby creating wear.

The inventor has taken an innovative approach to reduce vibration and stress and associated wear and crack formation at the interfaces by reducing the motion inside of the mechanical interface between the outer shroud and the groove in which it resides. This permits vibrations originating in the airfoil to pass through into the shrouds which, in turn, dissipate the motion to a controlled and limited freedom. The inventor further proposes an energy damping system that damps the redirected vibrational energy. Accordingly, the energy from the vibrations is permitted to travel to the shrouds, where it is harmlessly dissipated via the energy damping system. This reduces the need to increase component mass to overcome excess energy, which, in turn, enables a thinning of the airfoil, resulting in an increase in aerodynamic efficiency and longer component life span.

The energy damping system proposed includes connection assemblies that secure adjacent stationary vanes together. Each stationary vane may include an inner shroud, and outer shroud, and one airfoil connecting the two, (i.e. a singlet) and there may be a connection assembly between each adjacent singlet. Alternately, the energy damping system may secure adjacent stationary vanes together, where each adjacent stationary vane is part of a different vane sub-assembly. For example, two stationary vane sub-assemblies, each having an inner shroud, and outer shroud, and two airfoils may be secured together. In this instance, where a first vane sub-assembly is adjacent a second vane sub-assembly, one of the stationary vanes in the first vane sub-assembly is secured to one of the stationary vanes in the second vane sub-assembly. For this reason, while the figures depict singlet stationary vanes, the discussion and the principles apply equally to adjacent singlet stationary vanes and to adjacent vane sub-assemblies. As such, the discussion focuses on adjacent stationary vanes, which applies whether singlets or vane sub-assemblies are being considered. The singlets/segments may be assembled, or cast, forged, or otherwise manufactured as is known in the art. When a vane is cast, deleterious effects of porosity, inclusions and microfissure near and surrounding weld joints may be rendered moot. When forged, deleterious effects will not appear, but grain control at adverse locations cannot be controlled allowing for higher stresses vs. cast components.

These connection assemblies unite the adjacent stationary vanes to form a unified full or semi annulus of stationary vanes capable of damping vibrations introduced by one or more of the airfoils. Further, the energy damping system includes individually replaceable and/or tunable springs, dampers, and/or connectors. This permits individual selection and/adjustment of each component so that each connection assembly can be tuned to accommodate conditions local to the respective adjacent stationary vanes. Such tuning may occur initially, and may recur periodically throughout a life of the gas turbine engine to accommodate changes, such as engine wear etc. The connection assemblies may be part of a compressor or a turbine.

Consequently, a final design for the stage of vane sub-assemblies will be a balance. At one end of the spectrum singlets may be used. This would permit maximum energy damping and the greatest local tuning freedom, but may cost more to implement and maintain. At the other end of the spectrum vane sub-assemblies may be used to define the array. As the number of stationary vane sub-assemblies decreases so would the energy damping and local tuning freedom, but so also may the cost to implement and maintain FIG. 1 shows a stage 10 of stationary vanes 12 arranged in an annular array 14 about a longitudinal axis 16 of a gas turbine engine (not shown). The stationary vanes 12 shown are singlets 18 secured together side-to-side to form the annular array 14, each singlet 18 having an inner shroud 20, an outer shroud 22, and one airfoil 24 connecting the inner shroud 20 to the outer shroud 22. An energy damping system 30 includes a plurality of connection assemblies 32 disposed between adjacent stationary vanes 12. Each connection assembly 32 includes at least one spring 34, at least one damper, 36, and optionally an inner connecting element 38.

The springs 34 may be in compression and therefore tend to bias the stationary vanes 12 apart in a circumferential direction 40. Alternately, the springs 34 may be in tension and bias the stationary vanes 12 together in the circumferential direction 40. Accordingly, together the springs 34 create a load path 42 through the annular array 14, where the load path 42 may be compressive or tensile. The annular array 14 may be composed of two or more discrete semi-annular arrays 50, each mounted separately from the other and not connected to the other. In such an exemplary embodiment a respective load path 42 would exist within each semi-annular array 50.

In an exemplary embodiment, there may be a top semi-annular array 52 and a bottom semi-annular array 54, each having a semi-annular shape and each comprising vane sub-assemblies (not shown) or singlets 18. A base singlet 56 of the top semi-annular array 52 may be rigidly or loosely mounted to a mount 58 (partly shown) of the gas turbine engine at a specified angular position 60 of, for example, 270 degrees. The mount 58 may be an annular groove (not shown) configured to receive the outer shroud 22. The outer shrouds 22 of a remainder of the singlets 18 may also be positioned in the annular groove. In an exemplary embodiment when the base singlet 56 is rigidly mounted, the remaining singlets 18 may have slightly more freedom than the base singlet 56. In such an exemplary embodiment the outer shroud 22 of the base singlet 56 is not permitted to move axially, circumferentially, radially, or to rotate about a radial 62 of the singlet 18, and thereby acts as a fixed anchor for a remainder of the singlets 18 in the top semi-annular array 52, which are permitted limited movement in at least one of those directions, if not all. Alternately, the mount 58 may be mounted with limited freedom to move in at least one of those directions, in which case the remaining singlets 18 may float with the permitted movement of the base singlet 56. Alternately, the base singlet 56 may experience periods where it is rigidly mounted and periods when limited movement is permitted due to relative thermal growth and transient engine operating conditions etc.

Individual tailoring of the spring 34 and the damper 36 may result in relatively strong connection assembly 32 between the base singlet 56 and the adjacent stationary vane 12 because the base singlet 56 experiences the accumulated excess energy of all of the other stationary vanes 12 in that semi-annular array 50. The connection assembly 32 may become relatively weaker the farther it is located from the base singlet 56. The relatively weakest connection assembly 32 may be at the last stationary vane 12 and the adjacent stationary vane 100 (second to last), because it only needs to dissipate excess energy from the last two stationary vanes 12. The damping ratio between adjacent stationary vanes 12 may be underdamped ($\zeta<1$) while a damping ratio of the semi-annular array 50 may be critically damped ($\zeta=1$). The connection assembly 32 may be tuned to prevent certain high and/or low frequencies, such as those known to result from fluid flow and/or those known to result from mechanical motion such as rotating blades etc.

Likewise, a base singlet 66 of the bottom semi-annular array 54 may be mounted to the mount 58 at a specified angular position 70 of, for example, 90 degrees. The base singlet 66 of the bottom semi-annular array 54 may be rigidly or loosely mounted to the mount 58 at a specified angular position 60 of, for example, 90 degrees. The outer shrouds 22 of a remainder of the singlets 18 may also be in the annular groove. In an exemplary embodiment when the base singlet 66 is rigidly mounted, the remaining singlets 18 may have slightly more freedom than the base singlet 66. In such an exemplary embodiment the outer shroud 22 of the base singlet 66 is not permitted to move axially, circumferentially, radially, or to rotate about a radial 62 of the singlet 18, and thereby acts as a fixed anchor for a remainder of the singlets 18 the bottom semi-annular array 54, which are permitted limited movement in at least one of those directions. Alternately, the mount 58 may be mounted with limited freedom to move in at least one of those directions, in which case the remaining singlets 18 may float with the permitted movement of the base singlet 66. Alternately, the base singlet 66 may experience periods where it is rigidly mounted and periods when limited movement is permitted due to relative thermal growth and transient engine operating conditions etc. As was the case for the top semi-annular array 52, the bottom semi-annular array 54 may also be tuned.

While two semi-annular arrays of singlets 18 are disclosed, any number of less-than-fully-annular arrays may be used, each having its own base singlet, (or base vane segment), to fully compose the annular array and the above principles would apply. In addition, the less-than-fully-annular arrays need not be axisymmetric. For example, there may be one or more arrays that differ in the portion of the full annulus they occupy. There may be, for example, one semi-annular array, and two quarter-annulus arrays. The number of the less-than-fully-annular arrays and arc-length of each less-than-fully-annular array may be chosen based on any number of factors, including field assembly and disassembly considerations etc.

Figure 2:
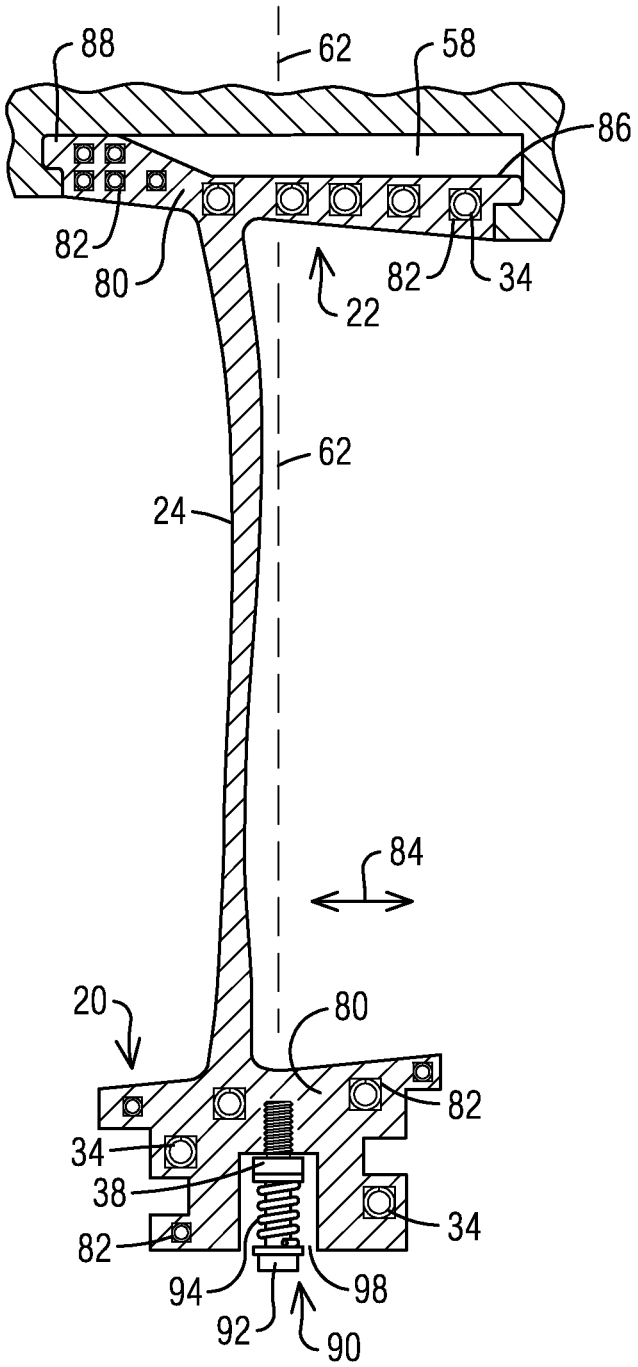
FIG. 2 is a cross sectional view along line A-A of an exemplary embodiment of the stationary vane of FIG. 1

FIG. 2 shows a side view of a singlet 18 along line A-A of FIG. 1, showing a mateface 80 (side surface) of the stationary vane 12 that abuts an adjacent mateface (not shown) of an adjacent stationary vane. There may be one or more recesses 82 in the mateface 80, and a spring 34 may reside in a respective recess 82. The spring 34 may be a coil spring or a compressible and/or an expandable material or arrangement etc. capable of imparting the requisite bias. The adjacent mateface may or may not have a recess 82 to coincide with the recess 82 in which a spring 34 resides. In the case where there is a recess 82 in the mateface 80 and a corresponding recess 82 in the adjacent mateface, both ends of the spring will reside in respective recesses 82. In the case where there is a recess 82 in one mateface 80 but not in the other, one end of the spring 34 may reside in the mateface and the other may simply rest on the adjacent mateface. There may be one spring 34 or more than one spring 34 between adjacent stationary vanes 12. The spring 34 may be located in the inner shroud 20, in the outer shroud 22, or when more than one spring 34 is used they may be in either or both the inner shroud 20 and the outer shroud 22. Any number of springs 34 may be used in any location as necessary and all may have the same spring constant or its own spring constant as necessary to tune the springs 34 for the respective adjacent stationary vanes 12. In addition, the springs 34 may be positioned farther upstream or downstream in an axial direction 84 as necessary.

Further, the location of the springs may vary from one set of adjacent stationary vanes 12 to another circumferentially. For example, if the stationary vane 12 shown in FIG. 1 were locally subject to a force that tended to separate an aft end 86 from an adjacent aft end (not shown), the springs (in compression) could be installed more toward a fore end 88 in the local area. Similarly, if a torque about the radial 62 is imparted by the flow being redirected by the stationary vane 12, then the springs 34 (in compression) could be angled fore-to-aft between the adjacent stationary vanes to counter the induced torque. (See FIG. 4.) For example, if the redirecting torque tended to rotate the aft end 86 toward the reader, one end of the spring 34 could be installed so that it contacts the stationary vane 12 more toward the aft end 86, and the other end of the spring 34 could be installed so that it contacts the adjacent stationary vane 12 (located out of the page and closer to the reader) more toward the fore end 88 of the adjacent stationary vane. In such an arrangement the spring would couple opposing torques that would cancel the torques induced by the redirected flow.

Also visible are an inner shroud connecting arrangement 90 including a fastener 92, a securing spring 94, and an inner connecting element 38 such as a bar that spans circumferentially from one inner shroud 20 to an adjacent inner shroud. The inner connecting element 38 may have a spring constant and the spring constant may be selected to meet damping requirements as desired. There may be one inner shroud connecting element 90 for each pair of adjacent stationary vanes 12, meaning there may be two fasteners 92 and two securing springs 94 in each inner shroud 20. The inner shroud connecting arrangement 90 is shown partially disposed in an inner shroud recess 98, clear of any nearby components like a rotor shaft (not shown). The inner connecting element 38 may be relatively stiff to overcome any bias felt at the inner shrouds 20 and exerted by the springs 34. The securing spring 94 will permit slight relative movement between the fastener 92 and the inner connecting element 38. This permits slight movement of the inner shroud 20 while also attempting to dampen movement from an equilibrium position. Either or both of the springs 34 and the inner shroud connecting arrangement 90 may be present at the inner shroud 20.

Figure 3:
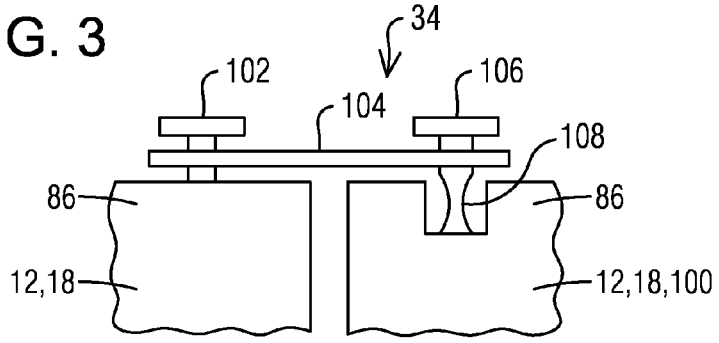
FIG. 3 is a rear view of an alternate exemplary embodiment of the spring.

FIG. 3 shows is a rear view of the stationary vane 12 of FIG. 2 and an adjacent stationary vane 100, showing an alternate exemplary embodiment of a spring 34 including a fixed fastener 102, a spring connecting element 104 that may be relatively inflexible, and a flexible fastener 106 such as a bolt with a flexible shank 108. The flexible fastener 106 may be pre-flexed in either direction and then tightened onto the spring connecting element 104 to provide the desired bias, and flex of the flexible shank 108 would provide the desired spring constant during operation.

Figure 4:
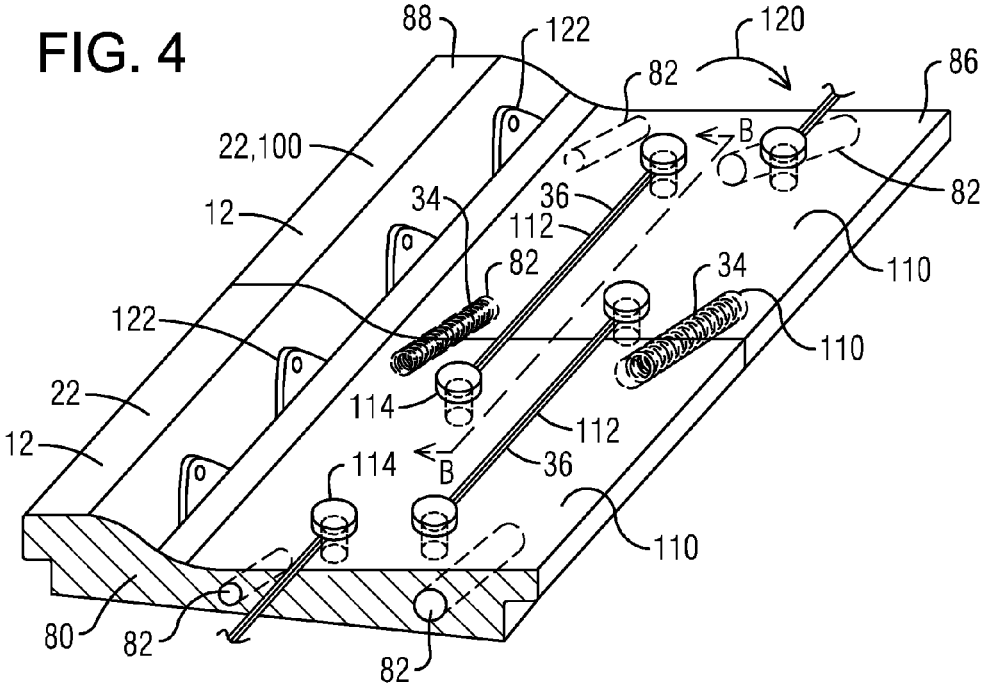
FIG. 4 is a partial perspective view of an exemplary embodiment of the outer shrouds of FIG. 1.

FIG. 4 is a partial perspective view of an exemplary embodiment of the outer shrouds 22 of the stationary vane 12 and the adjacent stationary vane 100, with dampers connecting the two. There may be one or more dampers 36 for each set of adjacent stationary vanes 12. They may or may not align circumferentially and they may or may not stagger their circumferential locations on an outer surface 110 of the outer shrouds 22 as shown. Each damper 36 may include a damper connecting element 112 and a damper post 114. Between the damper post 114 and the damper connecting element 112 there may be a damping element (not visible) effective to damp vibrational motion between the stationary vane 12 and the adjacent stationary vane 100. Also visible in FIG. 4 are angled recesses 82 in which the springs 34 may reside and in a configuration (when in compression) effective to overcome a clockwise torque 120 (as seen from above the outer surface 110) induced by the combustion gases turned by the airfoil 24.

Figure 5:
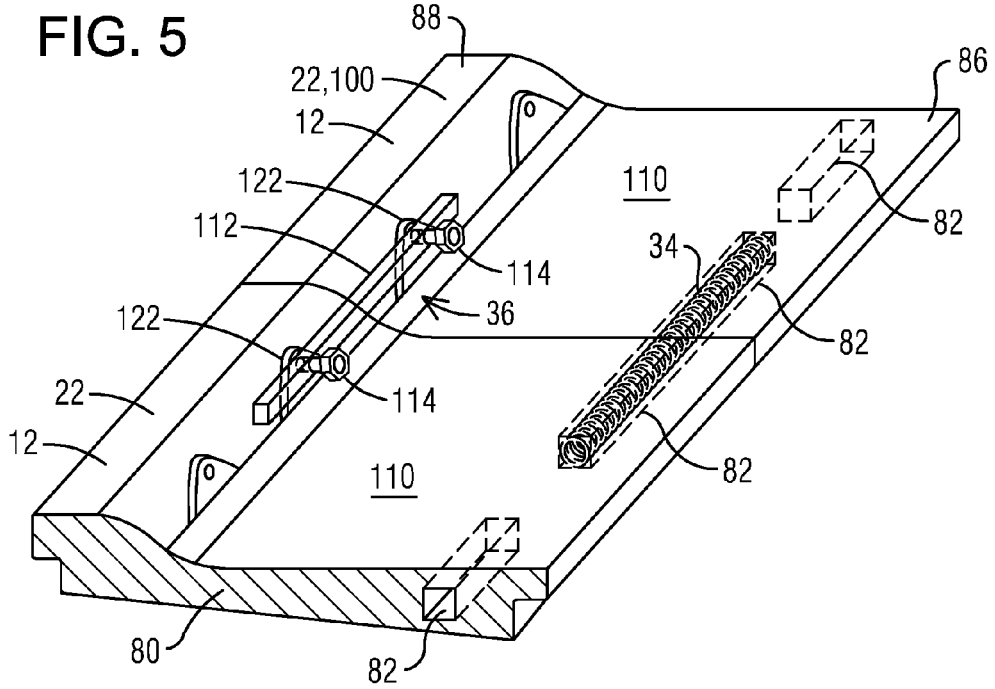
FIG. 5 is a partial perspective view of an exemplary embodiment of the outer shrouds of FIG. 1.

FIG. 5 is a partial perspective view of an alternate exemplary embodiment of the outer shrouds 22 of the stationary vane 12 and the adjacent stationary vane 100, with dampers 36 connecting the two. In this alternate exemplary embodiment, instead of being secured to the outer surface 110 of the outer shroud 22, the damper connecting elements 112 may instead be secured to pillars 122. The pillars 122 may align circumferentially as shown, and/or there may be more than one circumferential row of pillars so that more than one damper 36 can span adjacent stationary vanes 12, and/or there may be differing means for connecting the damper connecting element 112 to the respective pillar 122 to avoid interference with other damper connecting elements 112. Also visible are recesses 82 and a spring 34 with both ends disposed in cooperating recesses 82 in adjacent stationary vanes 12.

Figure 6:
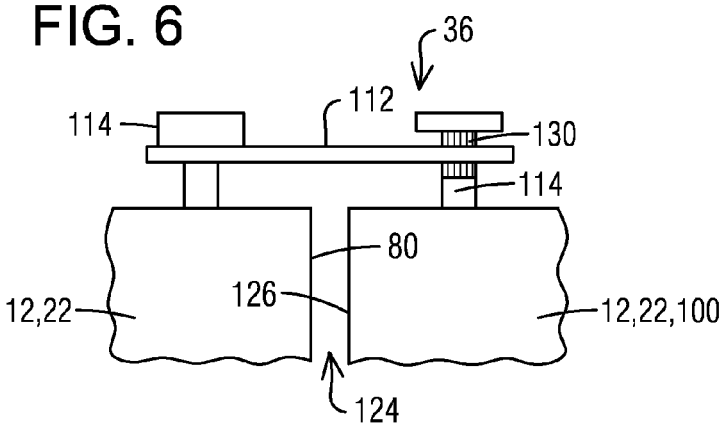
FIGS. 6-7 are rear views along B-B of FIG. 4 showing exemplary embodiments of the dampers of FIG. 4
Figure 7:
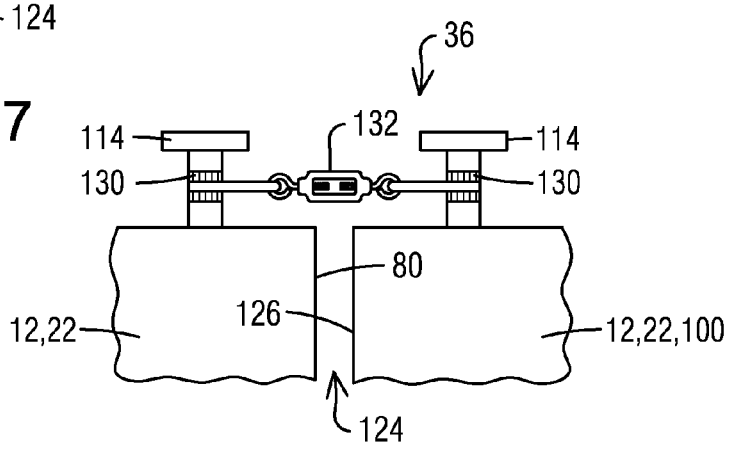

FIG. 6 is a rear view along B-B of FIG. 4 showing an exemplary embodiment of the damper 36, the damper connecting element 112, and the damper post 114 spanning a gap 124 between the stationary vane 12 and the adjacent stationary vane 100. The gap 124 is defined by the mateface 80 and the adjacent mateface 126. In the exemplary embodiment shown the damping element 130 may be positioned between the damper connecting element 112 and one or both damper posts 114. The damper may be, for example, a viscoelastic material or any other damper known to those in the art. Likewise, the configuration shown represents only one of many possible configurations known to those of ordinary skill in the art. A damper post 114 having a damping element 130 may be adjustable to control an amount of force pressing the damper connecting element 112 and the damping element 130 together. This may be used to control an amount of damping. Alternatively, a size (e.g. thickness) of the damping element 130 may be controlled to control the amount of damping. FIG. 7 is a rear view along B-B of FIG. 4 showing an alternate exemplary embodiment of the damper 36. In this configuration a turnbuckle 132 may be used to control an amount of preload between the adjacent stationary vanes 12.

Figure 8:
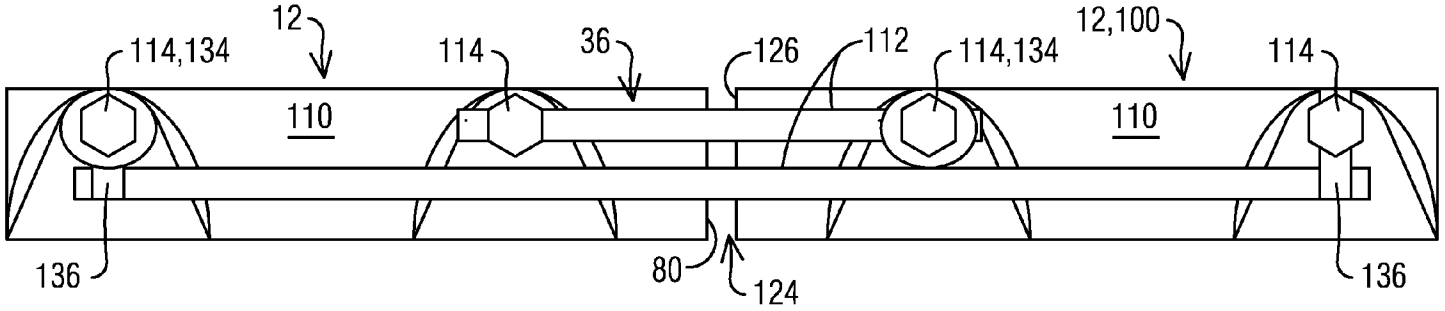

FIGS. 8-12 show various exemplary embodiments of the damper 36. FIG. 8 shows an exemplary embodiment where the damper 36 includes two damper connecting elements 112 between the stationary vane 12 and the adjacent stationary vane 100. Each damper connecting element 112 is secured by a set of damper posts 114. For each set of damper posts 114 there may be one or two damped damper posts 134, which is a damper post 114 with a damping element 130. Such an arrangement may simply provide redundancy, or it may allow the individual components to be selected with each other in mind to perform a particular tailoring of the relationship between the stationary vane 12 and the adjacent stationary vane 100. An offset connection 136 may be used to prevent the damper connecting elements 112 from interfering with each other.

Figure 9:
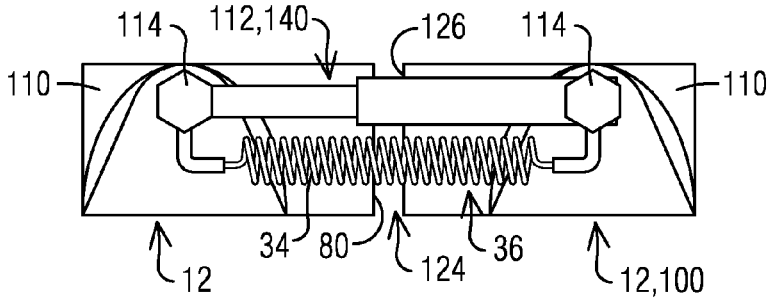
FIGS. 8-12 are top views showing various exemplary embodiments of the dampers of FIG. 4
Figure 10:
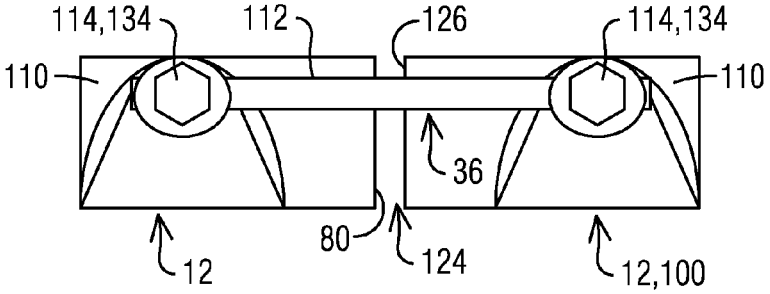
Figure 12:
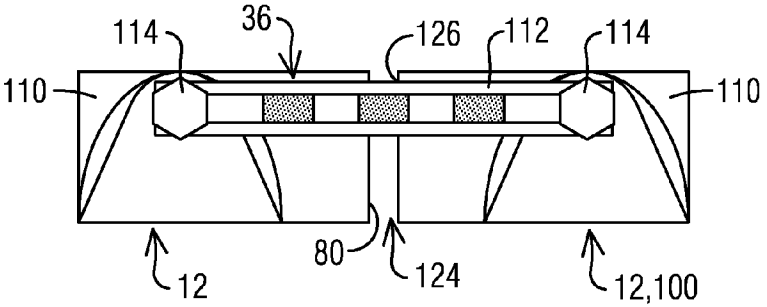
Figure 11:
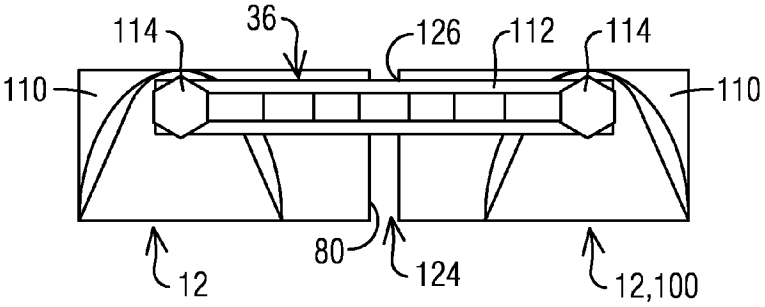

FIG. 9 shows an alternate exemplary embodiment where the damper connecting element 112 is a shock absorber 140. In this configuration there would be no need for a separate damping element 130 between the damper post 114 and the damper connecting element 112. In any of the exemplary embodiments shown herein, in addition or instead of being disposed in the recess 82, the spring 34 may be disposed between the damper posts 114, or between dedicated spring posts (not shown). FIG. 10 shows an alternate exemplary embodiment where the damper connecting element 112 is a rigid element and where both damper posts 114 are damped damper posts 134. FIG. 11 shows an alternate exemplary embodiment where the damper connecting element 112 comprises a material having a desired spring constant. FIG. 12 shows an alternate exemplary embodiment where the damper connecting element 112 comprises a composite material having a desired spring constant.

Other configurations consistent with the principles disclosed herein are considered to be within the scope of this disclosure. For each connection assembly 32 there may be one or more springs located between the stationary vanes 12 and/or on the outer shroud 22. Likewise, for each connection assembly 32 there may be one or more dampers 36, and in some embodiments both elements may be secured between damper posts 114 and/or in the recesses 82. For example, a damping element 130 may be disposed inside a coil spring, and the coil spring with the damping element 130 inside may be positioned in the recess 82. Each of these components can be individually replaceable, and each may be characterized by its own parameters. This allows tailoring of the spring constants and damping ratios between respective stationary vanes 12. Further, the springs 34 and the dampers 36 can be tuned radially and/or axially within each spring, damper, and connector assembly to accommodate radial and/or axial variations within a respective gap 124. Consequently, each connection assembly 32 may be the same as the others in any or all of construction, material, and/or parameters, each may be completely unique, or some may be the same and some unique in the same annular array 14.

From the foregoing it can be seen that the inventor has recognized the cause of crack formation and has innovatively departed from convention when devising the solution. Once the new approach became known to the inventor the solution was made possible using readily available components, thereby reducing the cost and complexity of implementation. Consequently, this represents an improvement in the art.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A stage of stationary vanes of a gas turbine engine, comprising:

a plurality of stationary vanes disposed in an annular array; and an energy damping system comprising a plurality of connection assemblies, each joining respective adjacent stationary vanes, a spring of a respective connection assembly is configured to circumferentially bias the respective adjacent stationary vanes, and a damper of the respective connection assembly is configured to oppose relative circumferential movement between the respective adjacent stationary vanes, wherein the spring includes a spring connecting element coupled to adjacent vanes in the stage of stationary vanes by a fixed fastener and a flexible fastener such that the flexible fastener is pre-flexed and tightened onto the spring connecting element to provide a desired bias.

2. The stage of stationary vanes of claim 1, wherein the spring is configured to circumferentially bias the respective adjacent stationary vanes apart from each other.

3. The stage of stationary vanes of claim 1, wherein each stationary vane of the respective adjacent stationary vanes comprises a mateface comprising a recess, and wherein the spring is disposed between the respective adjacent stationary vanes and in the recesses.

4. The stage of stationary vanes of claim 1, wherein at least one connection assembly is configured to permit individual adjustment of an amount of damping provided by a respective damper.

5. The stage of stationary vanes of claim 1, wherein each stationary vane comprises an inner shroud, and wherein each connection assembly further comprises a connecting element connecting respective adjacent inner shrouds together circumferentially.

6. A stage of stationary vanes of a gas turbine engine, comprising:

adjacent stationary vanes positioned circumferentially about a rotor in the gas turbine engine; and a connection assembly connecting the adjacent stationary vanes, comprising a spring that biases the adjacent stationary vanes circumferentially, and a damper that dampens relative circumferential movement between the adjacent stationary vanes, wherein the damper is configured as a shock absorber, and wherein the spring is disposed between and coupled to a plurality of damper posts of the damper.

7. The stage of stationary vanes of claim 6, wherein the adjacent stationary vanes are critically damped.

8. The stage of stationary vanes of claim 6, wherein at least one of the adjacent stationary vanes comprises a mateface comprising a recess, and wherein the spring is disposed in the mateface.

9. The stage of stationary vanes of claim 8, wherein at least one of the adjacent stationary vanes comprises an outer shroud, and wherein the recess is disposed in the outer shroud.

10. The stage of stationary vanes of claim 6, wherein each of the adjacent stationary vanes comprises an outer shroud, and wherein the damper is secured to each outer shroud.

11. The stage of stationary vanes of claim 6, wherein the damper is configured to permit adjustment of an amount of damping provided.

12. The stage of stationary vanes of claim 6, wherein each stationary vane comprises an inner shroud, and wherein the connection assembly further comprises a connecting element that secures the inner shrouds together circumferentially.

13. A stage of stationary vanes of a gas turbine engine, comprising:

a plurality of stationary vanes arranged in a semi-annular array;

a series of dampers, each connecting respective adjacent stationary vanes and each effective to dampen relative circumferential movement between the respective adjacent stationary vanes; and a series of springs, each connecting the respective adjacent stationary vanes, the series of springs effective to create a load path through the semi-annular array, wherein each of the springs in the series of connecting springs are angled fore-to-aft between adjacent stationary vanes effective to counter induced torque.

14. The stage of stationary vanes of claim 13, wherein the series of springs is effective to create a compressive load path through the semi-annular array.

15. The stage of stationary vanes of claim 13, wherein the semi-annular array is critically damped.

16. The stage of stationary vanes of claim 13, wherein each stationary vane comprises a singlet.

17. The stage of stationary vanes of claim 16, wherein each stationary vane comprises an outer shroud, wherein at least one of the adjacent stationary vanes comprises a mateface disposed on the outer shroud and comprising a recess, and wherein each spring is disposed in the respective recess.

18. The stage of stationary vanes of claim 13, wherein each stationary vane comprises an outer shroud, and wherein each damper is secured to the respective adjacent stationary vanes.

19. The stage of stationary vanes of claim 13, wherein each stationary vane comprises an inner shroud, the stage of stationary vanes further comprising a series of connecting elements, each connecting respective adjacent inner shrouds together circumferentially.

* * * * *